US009748060B2

(12) United States Patent
Klonowski et al.

(10) Patent No.: US 9,748,060 B2
(45) Date of Patent: Aug. 29, 2017

(54) HYBRID CUTOFF MEMBER FOR AN ELECTRIC CIRCUIT

(71) Applicant: TURBOMECA, Bordes (FR)

(72) Inventors: Thomas Klonowski, Sedzere (FR); Camel Serghine, Boeil-Bezing (FR)

(73) Assignee: TURBOMECA, Bordes (FR)

( * ) Notice: Subject to any disclaimer, the term of this patent is extended or adjusted under 35 U.S.C. 154(b) by 0 days.

(21) Appl. No.: 14/890,816

(22) PCT Filed: Jun. 4, 2014

(86) PCT No.: PCT/FR2014/051323

§ 371 (c)(1),
(2) Date: Nov. 12, 2015

(87) PCT Pub. No.: WO2014/202860

PCT Pub. Date: Dec. 24, 2014

(65) Prior Publication Data

US 2016/0126035 A1 May 5, 2016

(30) Foreign Application Priority Data

Jun. 17, 2013 (FR) ..... 13 55623

(51) Int. Cl.
*H01H 9/34* (2006.01)
*H01H 33/18* (2006.01)
(Continued)

(52) U.S. Cl.
CPC ..... *H01H 33/18* (2013.01); *H01H 9/547* (2013.01); *H01H 9/548* (2013.01);
(Continued)

(58) Field of Classification Search
CPC ..... H01H 2009/543; H01H 2009/544; H01H 2009/546; H01H 33/596; H01H 9/54; H01H 9/542; H01H 9/547
See application file for complete search history.

(56) References Cited

U.S. PATENT DOCUMENTS 6,215,632 B1 4/2001 Kaluza et al.
6,750,743 B1 * 6/2004 Subramanian ..... H01H 1/2058 200/306

(Continued)

FOREIGN PATENT DOCUMENTS

WO 97/34311 A1 9/1997
WO 2011/018113 A1 2/2011

OTHER PUBLICATIONS

International Search Report Issued Aug. 13, 2014, in PCT/FR14/51323 Filed Jun. 4, 2014.

*Primary Examiner* — Truc Nguyen
(74) *Attorney, Agent, or Firm* — Oblon, McClelland, Maier & Neustadt, L.L.P.

(57) ABSTRACT

A hybrid interrupter member for an electrical circuit, the interrupter member including a static interrupter component and an electromechanical interrupter component. The static component is mounted on a support carrying electrical contacts for the static component, the support being configured, on receiving a command to interrupt, to move in such a manner as to withdraw at least one of the electrical contacts from its respective pin, thereby forming the electromechanical interrupter component.

13 Claims, 3 Drawing Sheets

(51) Int. Cl.

| | |
|---|---|
| ***H01H 9/54*** | (2006.01) |
| ***H01H 33/59*** | (2006.01) |
| ***H01H 33/64*** | (2006.01) |
| ***H01H 33/666*** | (2006.01) |
| *H01H 1/20* | (2006.01) |
| *H01H 9/44* | (2006.01) |

(52) U.S. Cl.
CPC ..... *H01H 33/596* (2013.01); *H01H 33/64* (2013.01); *H01H 33/666* (2013.01); *H01H 1/20* (2013.01); *H01H 1/2041* (2013.01); *H01H 9/34* (2013.01); *H01H 9/443* (2013.01); *H01H 2033/6668* (2013.01)

(56) References Cited

U.S. PATENT DOCUMENTS

| | | | | |
|---|---|---|---|---|
| 2003/0198002 | A1 | 10/2003 | Vail et al. | |
| 2009/0278634 | A1* | 11/2009 | Lindsey | H01H 1/2041 335/10 |
| 2011/0102052 | A1 | 5/2011 | Billingsley et al. | |
| 2012/0186955 | A1* | 7/2012 | Birner | H01H 77/105 200/11 R |
| 2013/0327618 | A1* | 12/2013 | Mattlar | H01H 19/36 200/11 R |
| 2014/0340182 | A1* | 11/2014 | Dupraz | H02K 33/00 335/68 |

* cited by examiner

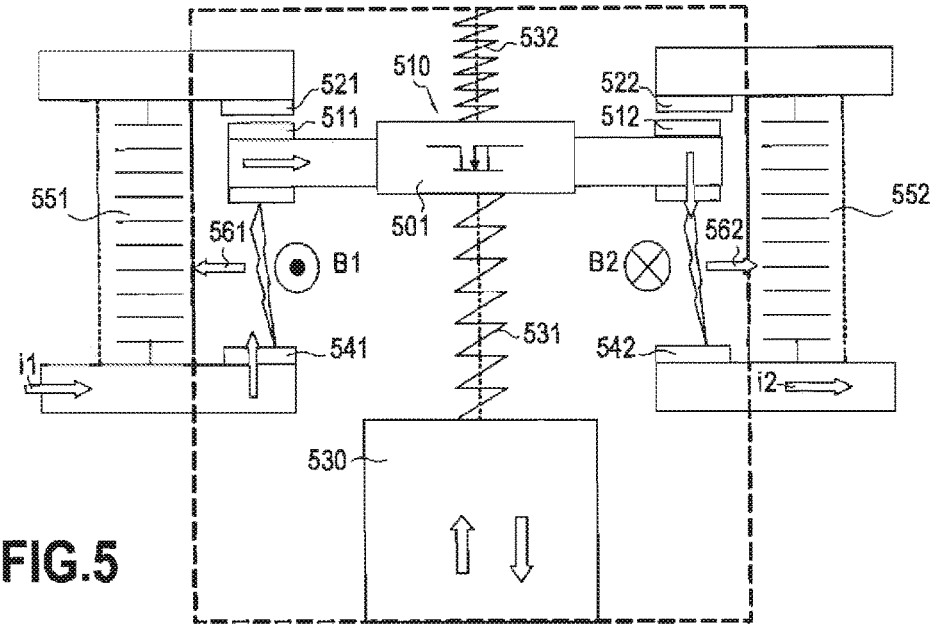
FIG.5
FIG.6
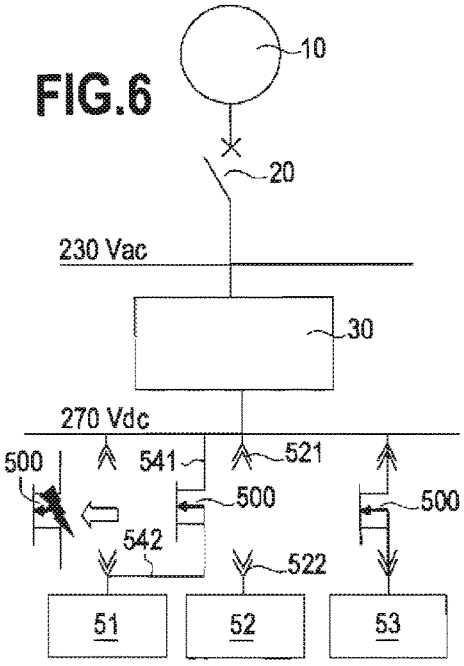
FIG.7
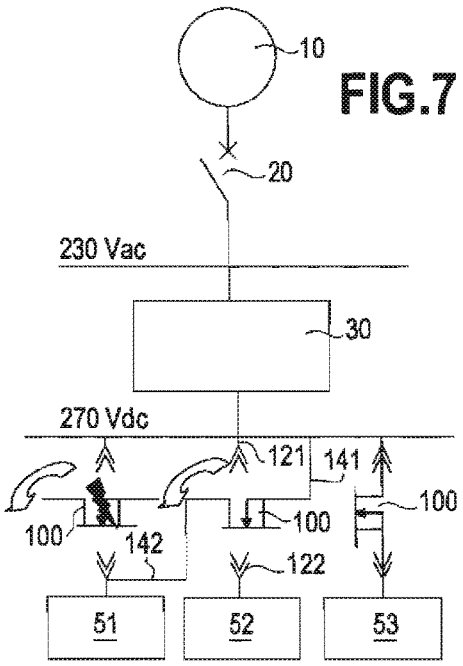

HYBRID CUTOFF MEMBER FOR AN ELECTRIC CIRCUIT

TECHNICAL CONTEXT

The invention lies in the field of electrical equipment, and in particular equipment for high voltage direct current (HVDC) electricity networks, such as those to be found on board aircraft such as airplanes or helicopters, and also for alternating current (AC) electricity networks. The invention relates more particularly to interrupter and/or switch members that often have a circuit protection function (circuit breakers). These members can be used with direct current (DC) or with pulse width modulated (PWM) DC, or with AC.

In this field, electromechanical interrupter and switch members of the contactor or circuit breaker type are known. Such members are relatively slow, and in addition they become worn by erosion as a result of electric arcs forming on their contacts when opening the electrical circuit.

Static contactors and circuit breakers are also known that are referred to as solid state power controllers (SSPCs). These components sometimes replace conventional electromechanical members, and they are based on semiconductor material structures. They are much faster than electromechanical members since they can interrupt or establish current in a few microseconds, as compared with a few milliseconds. Furthermore, the absence of contact materials and the absence of electric arc formation means that wear takes place more slowly. Finally, they can perform electrical functions that are more refined, such as complying with curves for triggering as a function of current variation in the circuit that is to be protected or a function of regulating voltage or current. And naturally, they are lighter in weight, which is of major importance in the field of aviation, and they consume less energy, which is also a considerable advantage. Even if their resistance when passing current is sometimes fairly high, there exist semiconductor materials, such as SiC, that present lower resistance and that are therefore potentially compatible with the voltages present in primary circuits.

Unfortunately, static components present hardly any ability to provide electrical isolation, which raises difficulties in high voltage circuits, and also in high current circuits. At present, they are therefore restricted in aircraft to certain secondary circuits where power consumption is not too great.

Proposals have been made to associate electromechanical systems with static components, in parallel and in series, but at present the solutions that have been proposed are cumbersome, bulky, and difficult to control.

Definition of the Invention and Associated Advantages

To solve the above-mentioned difficulties, there is provided a hybrid interrupter member for an electrical circuit, the interrupter member comprising a static interrupter component and an electromechanical interrupter component, the static component being mounted on a support carrying electrical contacts for the static component, said support being configured, on receiving a command to interrupt, to move in such a manner as to withdraw its two electrical contacts from their respective pins, thereby forming said electromechanical interrupter component.

Such a member is particularly easy to integrate in a circuit, and its static and electromechanical components can be controlled in a common, centralized manner. They make it possible to omit a fuse and thus to lower impedance, to program interrupting sequences that are appropriate for the dangerous situations that are to be encountered, and even to manage circuit and network reconfigurations, e.g. for the purpose of overcoming failures.

In an embodiment, the support is configured to move in turning, thus making it possible to devise a member that is compact and relatively insensitive to external conditions, and in particular to angle of inclination.

In another embodiment, the support is configured to move in translation, thus making it possible to devise a member capable of interrupting high currents without contact wear preventing it from operating properly. In this embodiment, it is advantageous for the movement of the support to be damped in order to avoid bounce, thereby avoiding secondary electric arcs forming.

The system may also comprise an electric arc extinction system, possibly based on an arc-control chamber polarized by a magnet, and optionally using a gas having high dielectric strength or extinction in a vacuum.

It is proposed that the static component be configured (or controlled) to interrupt nominal or low currents, while the electromechanical interrupter component is configured (or controlled) to interrupt short circuit or overload currents and to provide electrical isolation.

In particular, an interrupting sequence is proposed for a short circuit current, during which the static component is actuated after a waiting time after electromechanical opening, thereby enabling a portion of the interrupting energy to be dissipated in an electric arc prior to using the static component, which can therefore be small in size. The sequence nevertheless enables high currents to be interrupted very quickly.

An interrupting sequence is also proposed for a nominal or low current, in which the static component is actuated before electromechanical opening, thus enabling interrupting to be performed very quickly, while also obtaining effective electrical isolation once the circuit is opened.

The invention also provides a DC or AC electrical circuit including an interrupter member as described.

Under such circumstances, the support moves between two contact positions corresponding to two distinct circuit configurations.

The invention also provides a DC or AC electricity network for an aircraft comprising an electrical circuit as described, the interrupter member being placed in the primary circuit of the network or in the secondary circuit of the network.

LIST OF FIGURES

FIG. 5 shows a second embodiment of a hybrid interrupter member of the invention.

FIG. 6 shows an architecture of an aircraft electricity network using the embodiment shown in FIG. 5 and using the interrupter member to reconfigure the network.

FIG. 7 shows the interrupter member of FIGS. 3 and 4 used for reconfiguring the network of FIGS. 4 and 6.

The invention is described below with reference to the figures, which are given for purposes that are illustrative and not limiting.

DETAILED DESCRIPTION

Figure 1:
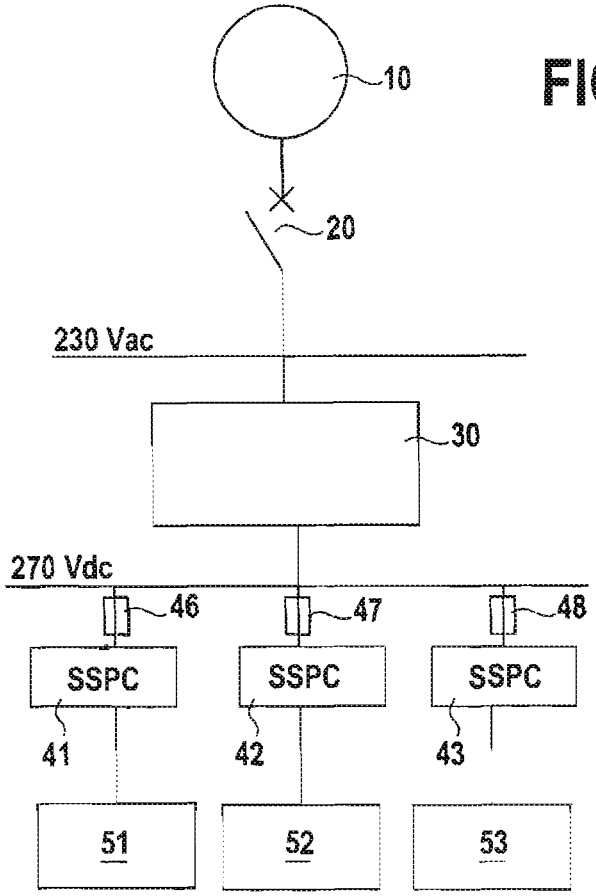
FIG. 1 shows an architecture intended for aircraft electricity networks.

FIG. 1 shows an architecture for an aircraft electricity network. It involves a generator 10 delivering an AC voltage at 230 volts (V), and a main circuit breaker 20 protecting the circuit downstream, i.e. initially an AC/DC converter 30. This converter converts the AC voltage into a DC voltage, e.g. at 270 V. This voltage is then distributed to three parallel circuits for powering three loads 51, 52, and 53. Each of these loads is protected by an interrupter member of the static component type 41, 42, or 43, and also by a fuse 46, 47, or 48, connected in series with the interrupter member 41, 42, or 43. Such an architecture is based on normal operation during which it is the static component that protects the corresponding load, but has provisions for the fuse to provide isolation in the event of the static component failing so as to isolate the fault (the load) from the remainder of the electricity network.

Such an architecture has the advantage of being of integrated design since the fuse can be located on the same printed circuit as the static component, however it implies an increase in line impedance because of the resistance of the fuse, and also a risk of triggering being slow or non-existent if the short circuit current is close to the nominal current. Furthermore, if the fuse is called on to act, it is subsequently necessary to intervene in order to put the circuit back into operation by replacing the fuse.

The invention is described with reference to the electricity network of FIG. 1, which is a DC network, but it also applies to an AC electricity network.

Figure 2:
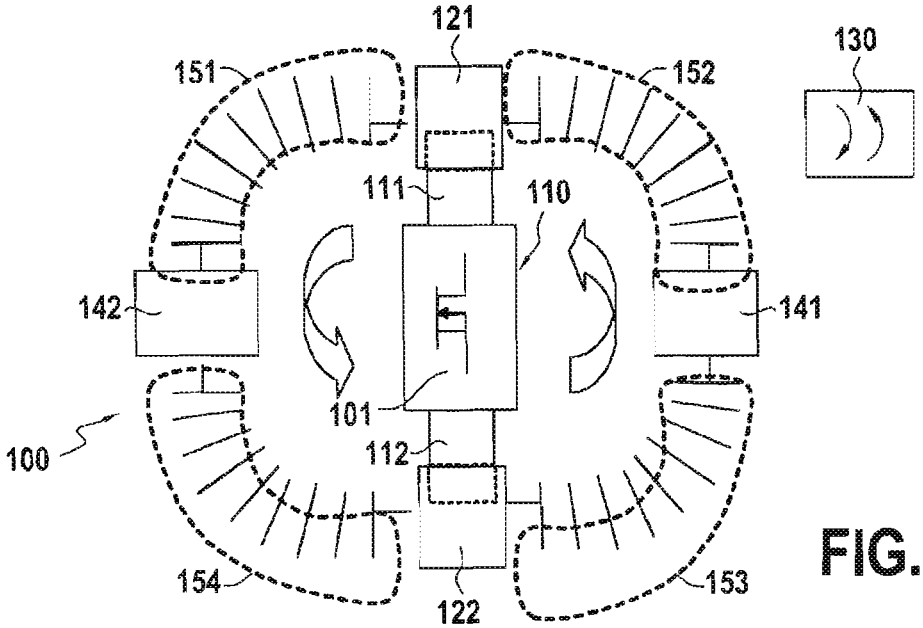
FIG. 2 shows an embodiment of a hybrid interrupter member of the invention, in its current-passing position.

FIG. 2 shows an integrated interrupter member 100 like the member described with reference to FIG. 1, but that solves the above-mentioned difficulties.

A static component 101 is placed on a plane rectangular support 110 having electrical contacts 111 and 112 at its two ends for passing electric current through the static component 101. The contacts 111 and 112 are suitable for inserting in an upstream pin 121 and a downstream pin 122 of the electrical circuit in which the cutoff member is to be inserted. These pins perform the electrical contact function, but insertion of the contacts 111 and 112 is reversible, so that the static component and its support, which together constitute the integrated interrupter member 100, can thus be plugged into or out of the electrical circuit.

The static component 101 is in general manner a semiconductor switch component such as a transistor, a metal oxide semiconductor field effect transistor (MOSFET) component or an insulated gate bipolar transistor (IGBT), and it is preferably encapsulated for protection purposes.

An actuator 130, e.g. an electromagnet, serves to cause the support 110 to turn about its central point in its own plane in one direction or the other, thereby plugging the static component into or out of the circuit. The actuator 130 receives a command as a function of the measured current or voltage.

Two electric poles 141 and 142 that are positioned relative to the pins 121 and 122 at an angle of 90° about the pivot axis serve to receive the electrical contacts 111 and 112 after the static component has turned through 90°, and if these poles are connected to a circuit, they serve to perform circuit switching, as described with reference to FIG. 8. Between each of the poles 121 and 122 and the poles 141 and 142, there are installed arc-control chambers 151, 152, 153, and 154, e.g. having interrupter fins and a gas mixture for extinguishing electric arcs, such as dinitrogen ($N_2$). It is also possible to use a system using a gas having high dielectric strength or arc extinction in a vacuum.

If the current is still flowing when the electromechanical portion is actuated, electric arcs are struck, blasted, and fragmented in the arc-control chambers through which the contacts 111 and 112 are moved after they have been unplugged from the poles 121 and 122.

It is preferable to use arc-control chambers that are polarized so that the speed at which the electric arc is blasted is fast enough, thereby having the consequence of increasing the effectiveness with which current is interrupted.

Figure 3:
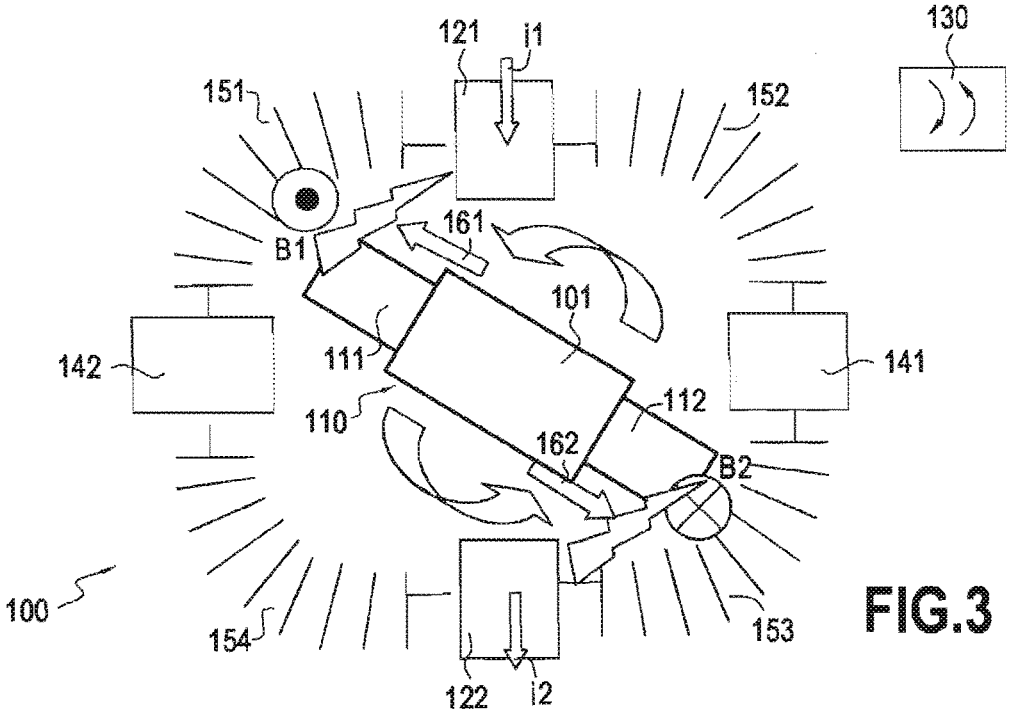
FIG. 3 shows the same interrupter member, while being actuated.

The polarization is shown in FIG. 3, which shows the magnetic field that is perpendicular to the plane of the support 110 of the static component 101, i.e. also perpendicular to the pivot plane. A magnetic field B1 is shown specifically in the arc-control chamber 151 between the poles 121 and 142, and a magnetic field B2 is shown in the arc-control chamber 153 between the poles 141 and 122. The fields B1 and B2 are in mutually opposite directions. The electric current arrives via the contact 121, as represented by arrows i1 and i2.

This figure also shows the movement of the support 110 when opening the electromechanical portion of the interrupter member. The contact 111 moves away from the pole 121 towards the pole 142, and the contact 112 moves away from the pole 122 towards the pole 141. Electric arcs appear between the contact 111 and the pole 121, and between the contact 112 and the pole 122. These arcs are blasted and fragmented in the arc-control chambers 151 and 153 as a result of the chambers being polarized, and also because of the metal fragmentation fins. Arrows 161 and 162 show the lines of action and the directions with which the two electric arcs are blasted, i.e. towards the outside of the device.

Such a situation in which the current is still passing at the moment the electromechanical portion is activated is advantageously used for interrupting high currents, such as short circuit currents or currents of magnitude exceeding a threshold, or currents having a derivative that is very high. Likewise, this strategy is applied if the arc-control chamber is effective in fragmenting the electric arc, which depends on the characteristics of the arc-control chamber and on the magnitude of the current.

Under such circumstances, it is proposed to actuate the electromechanical portion by means of a command sent to the actuator 130, thereby giving rise to the movements shown in FIG. 3. Thereafter, a few instants later, a command is sent to the static component 101 so that it too interrupts the flow of current.

Physically, the sequence involves creating electric arcs as shown in FIG. 3, with an arc voltage that increases with increasing effectiveness with which the arc-control chamber performs its function. The power P supplied by the generator 10 is then dissipated in part or in full in the electric arcs, and the magnitude of the current obeys the relationship $I=P/U$, where U is the arc voltage, which voltage is maximized by the arc-control chamber. A current is thus obtained that decreases quickly so as to disappear within a millisecond assuming that the static component 101 is not actuated. Nevertheless, the invention proposes actuating the static component 101, e.g. after 100 microseconds (μs) or 40 μs, as a function of the electrical power involved. Such a sequence makes it possible to dissipate a portion of the electrical energy in the electric arc without giving rise to high levels of erosion of the electrical contacts 121, 111, 122, and 112. It also makes it possible to dimension the static component 101 so that it is capable of interrupting currents of limited magnitude only, thus making it possible to conserve a device that is compact. Finally, the total interrupting time is short compared with a conventional electromechanical member, since it is possible to obtain a factor of 10 between the interrupting times usually obtained with conventional electromechanical devices and the times obtained with hybrid members as described herein and using the specified sequence.

Furthermore, where necessary, it is proposed to adapt the sequence to match the thermal state of the static component.

However, the integrated interrupter member 100 shown in FIG. 2 can also be used for interrupting nominal currents or currents of very small magnitude. Under such circumstances, the device is controlled using a sequence in the opposite order, since for such currents, the arc-control chamber would be of little effectiveness and the final interrupting time would be long. Thus, control begins by activating the static component 101, and subsequently activating the electromechanical portion of the system, in order to provide physical disconnection of the electrical circuit. The static component 101 makes it possible to obtain an interrupting time that is very short. There is no need for it to be dimensioned to be too bulky, given that it is required to interrupt low currents only.

Figure 4:
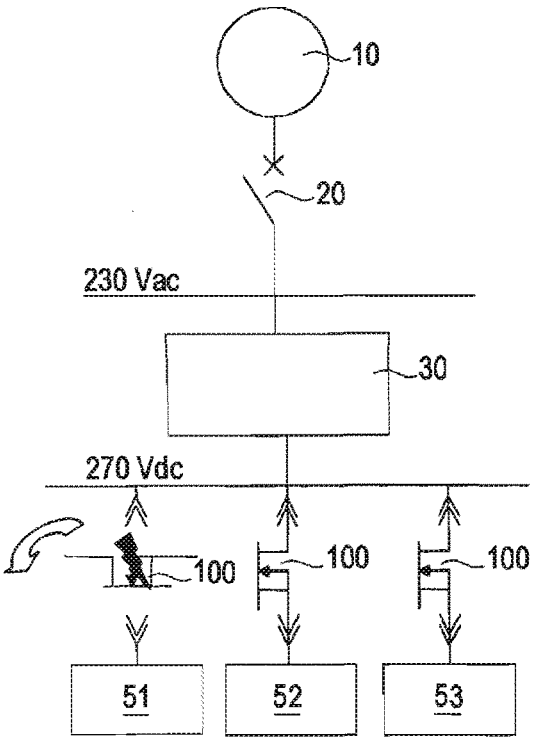
FIG. 4 shows an architecture for an aircraft electricity network making use of the embodiment shown in FIGS. 2 and 3.

FIG. 4 shows an aircraft electrical circuit in which the interrupter device 100 is inserted. Most of the elements shown in FIG. 1 can be seen again, however the fuse plus static component pairs 41 & 46, 42 & 47, and 43 & 48 are replaced by respective hybrid interrupter devices 100. The fact that these devices can be plugged in or plugged out is represented by double-headed arrows. The first of the hybrid interrupter devices is shown in its switched position, since its contacts are disconnected and the support has turned through 90°.

The hybrid interrupter member 100 described above is based on a support 110 turning about an axis. It has the advantage that it can be designed to be compact and to operate in reliable manner in numerous conditions and orientations.

FIG. 5 shows another embodiment of the invention, this time based on a support 510 that moves in translation. This is a hybrid interrupter member 500.

In a manner very similar to that described with reference to FIG. 2, a static component 501 is placed on a plane rectangular support 510 having electrical contacts 511 and 512 at its two ends so as to enable an electric current to pass through the static component 501. Its connections 511 and 512 are put electrically into contact with upstream and downstream connections 521 and 522 of the electrical circuit in which the interrupter member is to be inserted. Insertion of the contacts 111 and 112 is reversible.

An actuator 530, e.g. an electromagnet, serves to move the support 510 in translation perpendicularly to the line of the connections 521 and 522, i.e. also perpendicularly to the line of the contacts 511 and 512, thereby causing the static component to be electrically connected or disconnected. The actuator receives a command as a function of the measured current and/or voltage. Springs 531 and 532 serve to make the opening and the closing of the electromechanical system resilient so as to avoid electrical contact bounce, which could have the drawback of striking secondary electric arcs. The device is preferably positioned vertically, i.e. with the spring 531, the support 510, and the spring 532 following one another in a downward direction.

Two electrical poles 541 and 542 that are positioned relative to the pins 521 and 522 at a certain distance parallel to the axis of movement in translation serve to receive the electrical contacts 511 and 512 after the static component has moved in translation together with its support, and if these poles are connected to a circuit, they serve to perform circuit switching, as described below with reference to FIG. 7. Between the poles 521 and 541 and the poles 522 and 542, there are installed arc-control chambers 551 and 552, e.g. comprising interrupter fins, together with a gas mixture for encouraging the extinction of electric arcs. The electric arc blast system is similar to that described above. It involves polarizing by means of oppositely-acting magnetic fields B1 and B2 in the chambers 551 and 552, in order to blast the arcs towards the outside of the interrupter member 500. The arcs are shown in this example assuming that the support 510 of the poles 541 and 542 moves towards the poles 521 and 522. The current flow direction is represented by arrows i1, i2 and the blasting force is represented by arrows 561 and 562.

This embodiment based on a system for movement in translation is particularly advantageous for interrupting high currents, since in the event of the surfaces of the contacts and poles 511, 512, 521, 522, 541, and 542 becoming degraded, the contact function continues to be ensured and movement in translation continues to be possible. The system is thus particularly robust, even with high powers.

FIG. 6 shows an example of circuit reconfiguration using the interrupter member 500. Most of the elements of the circuit of FIG. 1 can be seen once more, however the fuse plus static component pairs 41 & 46, 42 & 47, and 43 & 48 are replaced by respective hybrid interrupter devices 500.

The reconfiguration described is performed assuming a failure of the control member controlling the interrupter member that protects the load 51 (failure represented by a lightning symbol). The interrupter member is then moved away by using the electromechanical function of the member. If the load 51 is a priority system for which continuity of service must be ensured, as is not the case for the load 52, the interrupter member that is protecting the load 52 is then selected for the purpose of powering and protecting the load 51. This is performed by moving the interrupter member of the load 52 in translation away from the poles 521 and 522, which are placed for feeding electricity to the load 52, to the poles 541 and 542, which are placed to feed electricity to the load 51, in an emergency.

FIG. 7 shows another example of circuit reconfiguration that is very similar to the example of FIG. 6, but that uses the hybrid interrupter member 100 operating by turning. Once more, the load 51 is considered as being a priority load, but its interrupter member has failed. It is taken out of circuit by being turned, and then the interrupter member powering the load 52 is also turned so that it is no longer in contact with the poles 121 and 122 arranged for powering the load 52, but rather with the poles 141 and 142 that are arranged for powering the load 51 in an emergency.

The network reconfigurations shown in FIGS. 6 and 7 serve to increase the reliability of the system. They can be implemented in the secondary network, but they can also be implemented in the primary network, given the ability of the interrupter members described to interrupt high currents.

The invention is not limited to the embodiments shown. In particular, in order to apply the principles of the invention, it is not absolutely essential to move both contacts of the support carrying the static interrupter component. Thus, a system involving turning about an axis placed through one of the two contacts could also perform the functions mentioned, using three poles instead of four.

The invention claimed is:

1. A hybrid interrupter member for an electrical circuit, the interrupter member comprising:

a static interrupter component; and an electromechanical interrupter component, the static interrupter component being a semiconductor switch component and being mounted on a support carrying two electrical contacts for the static interrupter component, the electromechanical interrupter component being configured, on receiving a command to interrupt, to move said support in such a manner as to withdraw at least one of said electrical contacts from a respective pin, wherein the electromechanical interrupter component includes an electromagnet which creates a magnetic field on receiving the command to interrupt so as to move the support and withdraw the at least one of the electrical contacts of the support from the respective pin.

2. A hybrid interrupter member according to claim 1, wherein the support is configured to move in turning.

3. A hybrid interrupter member according to claim 1, wherein the support is configured to move in translation.

4. A hybrid interrupter member according to claim 3, wherein the movement of the support is damped in order to avoid bounce.

5. A hybrid interrupter member according to claim 1, further including an electric arc extinction system.

6. A hybrid interrupter member according to claim 5, wherein the electric arc extinction system includes an arc-control chamber polarized by the electromagnet.

7. A hybrid interrupter member according to claim 1, wherein the static component is configured to interrupt nominal currents or low currents, while the electromechanical interrupter component is configured to interrupt short circuit currents or overload currents and to provide electrical isolation.

8. Controlling a hybrid interrupter member according to claim 1, in an interrupting sequence for a short circuit current, during which the static component is actuated after a waiting time after electromechanical opening, thereby enabling a portion of the interrupting energy to be dissipated in an electric arc.

9. Controlling a hybrid interrupter member according to claim 1, in an interrupting sequence for a nominal or low current, in which the static component is actuated before electromechanical opening.

10. A DC electrical circuit including an interrupter member according to claim 1.

11. An AC electrical circuit including an interrupter member according to claim 1.

12. An electrical circuit according to claim 10, wherein the support is moved between two contact positions corresponding to two distinct circuit configurations.

13. An aircraft electricity network including an electrical circuit according to claim 1, the interrupter member being placed in the primary circuit of the network, or in a secondary circuit of the network.

* * * * *